US008016969B2

(12) United States Patent
Oldorff

(10) Patent No.: US 8,016,969 B2
(45) **Date of Patent: *Sep. 13, 2011**

(54) PROCESS FOR FINISHING A WOODEN BOARD AND WOODEN BOARD PRODUCED BY THE PROCESS

(75) Inventor: Frank Oldorff, Schwerin (DE)

(73) Assignee: Flooring Technologies Ltd., Pieta (MT)

( * ) Notice: Subject to any disclaimer, the term of this patent is extended or adjusted under 35 U.S.C. 154(b) by 118 days.

This patent is subject to a terminal disclaimer.

(21) Appl. No.: 12/487,411

(22) Filed: Jun. 18, 2009

(65) Prior Publication Data

US 2009/0294037 A1 Dec. 3, 2009

Related U.S. Application Data

(63) Continuation of application No. 10/792,270, filed on Mar. 4, 2004, now Pat. No. 7,678,425.

(30) Foreign Application Priority Data

Mar. 6, 2003 (DE) ..... 103 10 199
Sep. 6, 2003 (EP) ..... 03020230

(51) Int. Cl.

| | |
|---|---|
| ***B32B 37/10*** | (2006.01) |
| ***B32B 37/14*** | (2006.01) |
| ***B32B 38/14*** | (2006.01) |
| ***B44C 1/24*** | (2006.01) |
| *B32B 5/22* | (2006.01) |
| *B44C 1/175* | (2006.01) |

(52) U.S. Cl. ..... 156/240; 156/235; 156/239; 156/277; 427/384; 427/393; 427/408; 427/372.2; 428/195.1; 428/537.1

(58) Field of Classification Search ..... 156/235, 156/239, 240, 277; 427/372.2, 384, 393, 427/408; 428/195.1, 537.1
See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |

(Continued)

FOREIGN PATENT DOCUMENTS

| | | |
|---|---|---|
| AT | 005566 | 8/2002 |

(Continued)

OTHER PUBLICATIONS

Webster Dictionary, p. 862.

(Continued)

*Primary Examiner* — Sonya Mazumdar
(74) *Attorney, Agent, or Firm* — Andrew M. Calderon; Roberts Mlotkowski Safran & Cole, P.C.

(57) ABSTRACT

A process for finishing a wood or wooden board, in particular an MDF or HDF board, with an upper side and an underside. The process includes applying a sealing layer of melamine resin to the upper side of the board and printing a decoration onto the sealing layer. A protective layer is applied of melamine resin to the decoration and the board is pressed under the action of temperature until the protective layer and the sealing layer melt and bond to each other with the inclusion of the decoration printed on.

16 Claims, 1 Drawing Sheet

U.S. PATENT DOCUMENTS

| | | | |
|---|---|---|---|
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,660,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,776,188 | A | 9/1930 | Langb'aum |
| 1,778,069 | A | 10/1930 | Fetz |
| 1,779,729 | A | 10/1930 | Bruce |
| 1,787,027 | A | 12/1930 | Wasleff |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |
| 1,921,164 | A | 8/1933 | Lewis |
| 1,929,871 | A | 10/1933 | Jones |
| 1,940,377 | A | 12/1933 | Storm |
| 1,946,648 | A | 2/1934 | Taylor |
| 1,953,306 | A | 4/1934 | Moratz |
| 1,986,739 | A | 1/1935 | Mitte |
| 1,988,201 | A | 1/1935 | Hall |
| 2,023,066 | A | 12/1935 | Curtis et al. |
| 2,044,216 | A | 6/1936 | Klages |
| 2,065,525 | A | 12/1936 | Hamilton |
| 2,123,409 | A | 7/1938 | Elmendorf |
| 2,220,606 | A | 11/1940 | Malarkey et al. |
| 2,276,071 | A | 3/1942 | Scull |
| 2,280,071 | A | 4/1942 | Hamilton |
| 2,324,628 | A | 7/1943 | Kähr |
| 2,328,051 | A | 8/1943 | Bull |
| 2,398,632 | A | 4/1946 | Frost et al. |
| 2,430,200 | A | 11/1947 | Wilson |
| 2,740,167 | A | 4/1956 | Rowley |
| 2,894,292 | A | 7/1959 | Gramelspacker |
| 3,045,294 | A | 7/1962 | Livezey, Jr. |
| 3,100,556 | A | 8/1963 | De Ridder |
| 3,125,138 | A | 3/1964 | Bolenbach |
| 3,173,804 | A | 3/1965 | Standfuss |
| 3,182,769 | A | 5/1965 | De Ridder |
| 3,203,149 | A | 8/1965 | Soddy |
| 3,204,380 | A | 9/1965 | Smith et al. |
| 3,267,630 | A | 8/1966 | Omholt |
| 3,282,010 | A | 11/1966 | King, Jr. |
| 3,286,006 | A | 11/1966 | Annand |
| 3,310,919 | A | 3/1967 | Bue et al. |
| 3,347,048 | A | 10/1967 | Brown et al. |
| 3,460,304 | A | 8/1969 | Braeuninger et al. |
| 3,481,810 | A | 12/1969 | Waite |
| 3,526,420 | A | 9/1970 | Brancaleone |
| 3,538,665 | A | 11/1970 | Gohner |
| 3,553,919 | A | 1/1971 | Omholt |
| 3,555,762 | A | 1/1971 | Costanzo, Jr. |
| 3,608,258 | A | 9/1971 | Spratt |
| 3,694,983 | A | 10/1972 | Couquet |
| 3,714,747 | A | 2/1973 | Curran |
| 3,720,027 | A | 3/1973 | Christensen |
| 3,731,445 | A | 5/1973 | Hoffmann et al. |
| 3,759,007 | A | 9/1973 | Thiele |
| 3,760,548 | A | 9/1973 | Sauer et al. |
| 3,768,846 | A | 10/1973 | Hensley et al. |
| 3,811,915 | A | 5/1974 | Burrell et al. |
| 3,853,578 | A | 12/1974 | Suzuki et al. |
| 3,859,000 | A | 1/1975 | Webster |
| 3,878,030 | A | 4/1975 | Cook |
| 3,902,293 | A | 9/1975 | Witt et al. |
| 3,908,053 | A | 9/1975 | Hettich |
| 3,912,569 | A | 10/1975 | Kapral |
| 3,936,551 | A | 2/1976 | Elmendorf et al. |
| 3,988,187 | A | 10/1976 | Witt et al. |
| 4,006,048 | A | 2/1977 | Cannady, Jr. et al. |
| 4,090,338 | A | 5/1978 | Bourgade |
| 4,091,136 | A | 5/1978 | O'Brian et al. |
| 4,099,358 | A | 7/1978 | Compaan |
| 4,118,533 | A | 10/1978 | Hipchen et al. |
| 4,131,705 | A | 12/1978 | Kubinsky |
| 4,164,832 | A | 8/1979 | Van Zandt |
| 4,169,688 | A | 10/1979 | Toshio |
| 4,242,390 | A | 12/1980 | Nemeth |
| 4,243,716 | A | 1/1981 | Kosaka et al. |
| 4,245,689 | A | 1/1981 | Grard et al. |
| 4,246,310 | A | 1/1981 | Hunt et al. |
| 4,290,248 | A | 9/1981 | Kemerer et al. |
| 4,299,070 | A | 11/1981 | Oltmanns et al. |
| 4,426,820 | A | 1/1984 | Terbrack et al. |
| 4,431,044 | A | 2/1984 | Bruneau |
| 4,471,012 | A | 9/1984 | Maxwell |
| 4,500,373 | A * | 2/1985 | Kubota ..... 156/79 |
| 4,501,102 | A | 2/1985 | Knowles |
| 4,520,062 | A | 5/1985 | Ungar et al. |
| 4,561,233 | A | 12/1985 | Harter et al. |
| 4,585,685 | A | 4/1986 | Forry et al. |
| 4,612,745 | A | 9/1986 | Hovde |
| 4,641,469 | A | 2/1987 | Wood |
| 4,653,242 | A | 3/1987 | Ezard |
| 4,654,244 | A | 3/1987 | Eckert et al. |
| 4,703,597 | A | 11/1987 | Eggemar |
| 4,715,162 | A | 12/1987 | Brightwell |
| 4,738,071 | A | 4/1988 | Ezard |
| 4,752,497 | A | 6/1988 | McConkey et al. |
| 4,756,951 | A | 7/1988 | Wang et al. |
| 4,769,963 | A | 9/1988 | Meyerson |
| 4,819,932 | A | 4/1989 | Trotter, Jr. |
| 4,831,806 | A | 5/1989 | Niese et al. |
| 4,845,907 | A | 7/1989 | Meek |
| 4,849,768 | A | 7/1989 | Graham |
| 4,856,857 | A | 8/1989 | Takeuchi et al. |
| 4,890,656 | A | 1/1990 | Ohsumi et al. |
| 4,905,442 | A | 3/1990 | Daniels |
| 4,947,602 | A | 8/1990 | Pollasky |
| 5,029,425 | A | 7/1991 | Bogataj |
| 5,103,614 | A | 4/1992 | Kawaguchi et al. |
| 5,113,632 | A | 5/1992 | Hanson |
| 5,117,603 | A | 6/1992 | Weintraub |
| 5,136,823 | A | 8/1992 | Pellegrino |
| 5,165,816 | A | 11/1992 | Parasin |
| 5,179,812 | A | 1/1993 | Itill |
| 5,205,091 | A | 4/1993 | Brown |
| 5,216,861 | A | 6/1993 | Meyerson |
| 5,251,996 | A | 10/1993 | Hiller et al. |
| 5,253,464 | A | 10/1993 | Nilsen |
| 5,283,102 | A | 2/1994 | Sweet et al. |
| 5,295,341 | A | 3/1994 | Kajiwara |
| 5,335,473 | A | 8/1994 | Chase |
| 5,348,778 | A | 9/1994 | Knipp et al. |
| 5,349,796 | A | 9/1994 | Meyerson |
| 5,390,457 | A | 2/1995 | Sjölander |
| 5,413,834 | A | 5/1995 | Hunter et al. |
| 5,433,806 | A | 7/1995 | Pasquali et al. |
| 5,474,831 | A | 12/1995 | Nystrom |
| 5,497,589 | A | 3/1996 | Porter |
| 5,502,939 | A | 4/1996 | Zadok et al. |
| 5,540,025 | A | 7/1996 | Takehara et al. |
| 5,567,497 | A | 10/1996 | Zegler et al. |
| 5,570,554 | A | 11/1996 | Searer |
| 5,597,024 | A | 1/1997 | Bolyard et al. |
| 5,629,259 | A | 5/1997 | Akada et al. |
| 5,630,304 | A | 5/1997 | Austin |
| 5,653,099 | A | 8/1997 | MacKenzie |
| 5,671,575 | A | 9/1997 | Wu |
| 5,694,734 | A | 12/1997 | Cercone et al. |
| 5,706,621 | A | 1/1998 | Pervan |
| 5,736,227 | A | 4/1998 | Sweet et al. |
| 5,768,850 | A | 6/1998 | Chen |

5,797,175 A 8/1998 Schneider
5,797,237 A 8/1998 Finkell, Jr.
5,823,240 A 10/1998 Bolyard et al.
5,827,592 A 10/1998 Van Gulik et al.
5,830,548 A 11/1998 Andersen et al.
5,855,717 A * 1/1999 Beer et al. ..... 156/240
5,860,267 A 1/1999 Pervan
5,935,668 A 8/1999 Smith
5,943,239 A 8/1999 Shamblin et al.
5,953,878 A 9/1999 Johnson
5,968,625 A 10/1999 Hudson
5,985,397 A 11/1999 Witt et al.
5,987,839 A 11/1999 Hamar et al.
6,006,486 A 12/1999 Moriau et al.
6,023,907 A 2/2000 Pervan
6,065,262 A 5/2000 Motta
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,168,866 B1 1/2001 Clark
6,182,410 B1 2/2001 Pervan
6,186,703 B1 2/2001 Shaw
6,205,639 B1 3/2001 Pervan
6,209,278 B1 4/2001 Tychsen
6,216,403 B1 4/2001 Belbeoc'h
6,216,409 B1 4/2001 Roy et al.
D442,296 S 5/2001 Külik
D442,297 S 5/2001 Külik
D442,298 S 5/2001 Külik
D442,706 S 5/2001 Külik
D442,707 S 5/2001 Külik
6,224,698 B1 5/2001 Endo
6,238,798 B1 5/2001 Kang et al.
6,247,285 B1 6/2001 Moebus
D449,119 S 10/2001 Külik
D449,391 S 10/2001 Külik
D449,392 S 10/2001 Külik
6,324,803 B1 12/2001 Pervan
6,345,481 B1 2/2002 Nelson
6,363,677 B1 4/2002 Chen et al.
6,397,547 B1 6/2002 Martensson
6,413,364 B1 7/2002 Sandison
6,418,683 B1 7/2002 Martensson et al.
6,421,970 B1 7/2002 Martensson et al.
6,427,408 B1 8/2002 Krieger
6,436,159 B1 8/2002 Safta et al.
6,438,919 B1 8/2002 Knauseder
6,446,405 B1 9/2002 Pervan
6,449,913 B1 9/2002 Shelton
6,449,918 B1 9/2002 Nelson
6,453,632 B1 9/2002 Huang
6,458,232 B1 10/2002 Valentinsson
6,460,306 B1 10/2002 Nelson
6,461,636 B1 10/2002 Arth et al.
6,465,046 B1 10/2002 Hansson et al.
6,490,836 B1 12/2002 Moriau et al.
6,497,961 B2 12/2002 Kang et al.
6,510,665 B2 1/2003 Pervan
6,516,579 B1 2/2003 Pervan
6,517,935 B1 2/2003 Kornfalt et al.
6,519,912 B1 2/2003 Eckmann et al.
6,521,314 B2 2/2003 Tychsen
6,532,709 B2 3/2003 Pervan
6,533,855 B1 3/2003 Gaynor et al.
6,536,178 B1 3/2003 Pålsson et al.
6,546,691 B2 4/2003 Peopolder
6,551,702 B1 4/2003 Biedermann et al.
6,553,724 B1 4/2003 Bigler
6,558,754 B1 5/2003 Velin et al.
6,565,919 B1 5/2003 Hansson et al.
6,568,148 B1 5/2003 Eisermann
6,569,272 B2 5/2003 Tychsen
6,588,166 B2 7/2003 Martensson et al.
6,591,568 B1 7/2003 Palsson
6,601,359 B2 8/2003 Olofsson
6,606,834 B2 8/2003 Martensson et al.
6,617,009 B1 9/2003 Chen et al.
6,635,174 B1 10/2003 Berg et al.
6,641,629 B2 11/2003 Safta et al.
6,646,088 B2 11/2003 Fan et al.
6,647,690 B1 11/2003 Martensson
6,649,687 B1 11/2003 Gheewala et al.
6,659,097 B1 12/2003 Houston
6,672,030 B2 1/2004 Schulte
6,675,545 B2 1/2004 Chen et al.
6,681,820 B2 1/2004 Olofsson
6,682,254 B1 1/2004 Olofsson et al.
6,685,993 B1 2/2004 Hansson et al.
6,711,864 B2 3/2004 Erwin
6,711,869 B2 3/2004 Tychsen
6,715,253 B2 4/2004 Pervan
6,723,438 B2 4/2004 Chang et al.
6,729,091 B1 5/2004 Martensson
6,745,534 B2 6/2004 Kornfalt
6,761,008 B2 7/2004 Chen et al.
6,761,794 B2 7/2004 Mott et al.
6,763,643 B1 7/2004 Martensson
6,766,622 B1 7/2004 Thiers
6,769,217 B2 8/2004 Nelson
6,769,218 B2 8/2004 Pervan
6,769,835 B2 8/2004 Stridsman
6,772,568 B2 8/2004 Thiers et al.
6,786,019 B2 9/2004 Thiers
6,803,109 B2 10/2004 Qiu et al.
6,805,951 B2 10/2004 Kornfält et al.
6,823,638 B2 11/2004 Stanchfield
6,841,023 B2 1/2005 Mott
7,137,229 B2 11/2006 Pervan
7,171,998 B2 2/2007 Vogel
2001/0010839 A1 8/2001 Martino
2001/0029720 A1 10/2001 Pervan
2001/0034992 A1 11/2001 Pletzer et al.
2002/0007608 A1 1/2002 Pervan
2002/0007609 A1 1/2002 Pervan
2002/0014047 A1 2/2002 Thiers
2002/0020127 A1 2/2002 Thiers et al.
2002/0046528 A1 4/2002 Pervan et al.
2002/0056245 A1 5/2002 Thiers
2002/0106439 A1 8/2002 Cappelle
2002/0160680 A1 10/2002 Laurence et al.
2003/0024200 A1 2/2003 Moriau et al.
2003/0024201 A1 2/2003 Moriau et al.
2003/0029115 A1 2/2003 Moriau et al.
2003/0029116 A1 2/2003 Moriau et al.
2003/0029117 A1 2/2003 Moriau et al.
2003/0033777 A1 2/2003 Thiers et al.
2003/0033784 A1 2/2003 Pervan
2003/0115812 A1 6/2003 Pervan
2003/0115821 A1 6/2003 Pervan
2003/0159385 A1 8/2003 Thiers
2003/0167717 A1 9/2003 Garcia
2003/0196405 A1 10/2003 Pervan
2003/0205013 A1 11/2003 Garcia
2003/0233809 A1 12/2003 Pervan
2004/0016196 A1 1/2004 Pervan
2004/0035078 A1 2/2004 Pervan
2004/0092006 A1 5/2004 Lindekens et al.
2004/0105994 A1 6/2004 Lu et al.
2004/0139678 A1 7/2004 Pervan
2004/0159066 A1 8/2004 Thiers et al.
2004/0177584 A1 9/2004 Pervan
2004/0200165 A1 10/2004 Garcia et al.
2004/0206036 A1 10/2004 Pervan
2004/0237447 A1 12/2004 Thiers et al.
2004/0237448 A1 12/2004 Thiers et al.
2004/0241374 A1 12/2004 Thiers et al.
2004/0244322 A1 12/2004 Thiers et al.
2004/0250493 A1 12/2004 Thiers et al.
2004/0255541 A1 12/2004 Thiers et al.
2004/0258907 A1 12/2004 Kornfalt et al.
2005/0003149 A1 1/2005 Kornfalt et al.
2005/0016099 A1 1/2005 Thiers
2005/0089644 A1 4/2005 Oldorff

FOREIGN PATENT DOCUMENTS

| | | |
|---|---|---|
| AU | 713628 | 5/1998 |
| AU | 200 020703 | 1/2000 |
| BE | 417526 | 9/1936 |
| BE | 557844 | 6/1957 |
| BE | 557844 | 3/1960 |
| BE | 09 600527 | 6/1998 |
| BE | 09 700344 | 10/1998 |
| CA | 991373 | 6/1976 |
| CA | 2 226286 | 12/1997 |
| CA | 2 252791 | 5/1999 |
| CA | 2 289309 | 7/2000 |
| CH | 200949 | 1/1939 |
| CH | 211877 | 1/1941 |
| CH | 562377 | 5/1975 |
| DE | 314207 | 9/1919 |
| DE | 531989 | 8/1931 |
| DE | 1 534802 | 4/1940 |
| DE | 740235 | 10/1943 |
| DE | 1 089966 | 9/1960 |
| DE | 1534278 | 2/1966 |
| DE | 1212225 | 3/1966 |
| DE | 1212275 | 3/1966 |
| DE | 7 102476 | 6/1971 |
| DE | 2 007129 | 9/1971 |
| DE | 1 534278 | 11/1971 |
| DE | 2 252643 | 10/1972 |
| DE | 2238660 | 2/1974 |
| DE | 7402354 | 5/1974 |
| DE | 24 54 343 | 5/1976 |
| DE | 2502992 | 7/1976 |
| DE | 2 616077 | 10/1977 |
| DE | 2616077 | 10/1977 |
| DE | 2 917025 | 11/1980 |
| DE | 2917025 | 11/1980 |
| DE | 7911924 | 3/1981 |
| DE | 7 928703 | 5/1981 |
| DE | 3 041781 | 6/1982 |
| DE | 3041781 | 6/1982 |
| DE | 3214207 | 11/1982 |
| DE | 8226153 | 1/1983 |
| DE | 3343601 | 6/1985 |
| DE | 86 040049 | 6/1986 |
| DE | 3512204 | 10/1986 |
| DE | 3 246376 | 2/1987 |
| DE | 4 004891 | 9/1990 |
| DE | 4002547 | 8/1991 |
| DE | 4134452 | 4/1993 |
| DE | 4215273 | 11/1993 |
| DE | 4 242530 | 6/1994 |
| DE | 43 04 491 | 8/1994 |
| DE | 4011656 | 1/1995 |
| DE | 4324137 | 1/1995 |
| DE | 4 107151 | 2/1995 |
| DE | 29 517128 | 2/1996 |
| DE | 4 242530 | 9/1996 |
| DE | 3 544845 | 12/1996 |
| DE | 195 29 987 | 2/1997 |
| DE | 195 32 819 | 3/1997 |
| DE | 29 710175 | 9/1997 |
| DE | 19 616510 | 3/1998 |
| DE | 19 651149 | 6/1998 |
| DE | 19 709641 | 9/1998 |
| DE | 19 718319 | 11/1998 |
| DE | 197 51 115 | 5/1999 |
| DE | 19 735189 | 6/2000 |
| DE | 20 001225 | 8/2000 |
| DE | 199 03 913 | 8/2000 |
| DE | 19 925248 | 12/2000 |
| DE | 20 017461 | 3/2001 |
| DE | 20 018284 | 3/2001 |
| DE | 199 41 300 | 3/2001 |
| DE | 100 12 136 | 9/2001 |
| DE | 100 19 054 | 12/2001 |
| DE | 20 206460 | 8/2002 |
| DE | 101 17 807 | 10/2002 |
| DE | 20 218331 | 5/2004 |
| EP | 0 248127 | 12/1987 |
| EP | 0 574 953 | 12/1993 |
| EP | 0 623724 | 11/1994 |
| EP | 0 652340 | 5/1995 |
| EP | 0 667936 | 8/1995 |
| EP | 0 690185 | 1/1996 |
| EP | 0 849416 | 6/1998 |
| EP | 0698162 | 9/1998 |
| EP | 0 903451 | 3/1999 |
| EP | 0855482 | 12/1999 |
| EP | 0 969163 | 1/2000 |
| EP | 0 969164 | 1/2000 |
| EP | 0877130 | 1/2000 |
| EP | 0969164 | 1/2000 |
| EP | 0974713 | 1/2000 |
| EP | 1 026 008 | 8/2000 |
| EP | 0843763 | 10/2000 |
| EP | 1 200690 | 5/2002 |
| EP | 0 958441 | 7/2003 |
| EP | 1026341 | 8/2003 |
| ES | 163421 | 9/1968 |
| ES | 460194 | 5/1978 |
| ES | 283331 | 5/1985 |
| ES | 1 019585 | 12/1991 |
| ES | 1019585 | 1/1992 |
| ES | 2168045 | 5/2002 |
| FI | 843060 | 8/1984 |
| FR | 1293043 | 4/1962 |
| FR | 2691491 | 11/1983 |
| FR | 2 568295 | 5/1986 |
| FR | 2623544 | 5/1989 |
| FR | 2 630149 | 10/1989 |
| FR | 2637932 | 4/1990 |
| FR | 2 675174 | 10/1991 |
| FR | 2667639 | 4/1992 |
| FR | 2 691491 | 11/1993 |
| FR | 2 697275 | 4/1994 |
| FR | 2712329 | 5/1995 |
| FR | 2 776956 | 10/1999 |
| FR | 2781513 | 1/2000 |
| FR | 2785633 | 5/2000 |
| GB | 424057 | 2/1935 |
| GB | 585205 | 1/1947 |
| GB | 599793 | 3/1948 |
| GB | 636423 | 4/1950 |
| GB | 812671 | 4/1959 |
| GB | 1033866 | 6/1966 |
| GB | 1034117 | 6/1966 |
| GB | 1044846 | 10/1966 |
| GB | 1 237744 | 6/1968 |
| GB | 1 127915 | 9/1968 |
| GB | 1 275511 | 5/1972 |
| GB | 1 399402 | 7/1975 |
| GB | 1399402 | 7/1975 |
| GB | 1 430423 | 3/1976 |
| GB | 1430423 | 3/1976 |
| GB | 2 117813 | 10/1983 |
| GB | 2126106 | 3/1984 |
| GB | 2152063 | 7/1985 |
| GB | 2238660 | 6/1991 |
| GB | 2243381 | 10/1991 |
| GB | 2256023 | 11/1992 |
| JP | 54-65528 | 5/1979 |
| JP | 57-119056 | 7/1982 |
| JP | 59-186336 | 10/1984 |
| JP | 3-169967 | 7/1991 |
| JP | 4-106264 | 4/1992 |
| JP | 5-148984 | 6/1993 |
| JP | 6-56310 | 5/1994 |
| JP | 6-146553 | 5/1994 |
| JP | 6-200611 | 7/1994 |
| JP | 6-320510 | 11/1994 |
| JP | 7-76923 | 3/1995 |
| JP | 7-180333 | 7/1995 |
| JP | 7-300979 | 11/1995 |
| JP | 7-310426 | 11/1995 |
| JP | 8-109734 | 4/1996 |
| JP | 8-270193 | 10/1996 |
| NE | 7 601773 | 2/1976 |
| NO | 157871 | 2/1988 |
| NO | 305614 | 6/1999 |

| | | |
|---|---|---|
| SE | 711 4900-9 | 9/1974 |
| SE | 450141 | 6/1987 |
| SE | 450411 | 6/1987 |
| SE | 501014 | 10/1994 |
| SE | 501914 | 6/1995 |
| SE | 502994 | 4/1996 |
| SE | 506254 | 11/1997 |
| SE | 509059 | 11/1998 |
| SE | 509060 | 11/1998 |
| SE | 512290 | 2/2000 |
| SE | 512313 | 2/2000 |
| SE | 0000200-6 | 8/2001 |
| SU | 363795 | 12/1972 |
| WO | 84/02155 | 6/1984 |
| WO | 87/03839 | 7/1987 |
| WO | 89/08539 | 9/1989 |
| WO | 92/17657 | 10/1992 |
| WO | 93/13280 | 7/1993 |
| WO | 93/19910 | 10/1993 |
| WO | 94/01628 | 1/1994 |
| WO | 94/26999 | 11/1994 |
| WO | 94 26999 | 11/1994 |
| WO | 95/06176 | 3/1995 |
| WO | 96/27719 | 9/1996 |
| WO | 96/27721 | 9/1996 |
| WO | 96/30177 | 10/1996 |
| WO | 97/47834 | 12/1997 |
| WO | 98/24495 | 6/1998 |
| WO | 98/24994 | 6/1998 |
| WO | 98/38401 | 9/1998 |
| WO | 99 40273 | 8/1999 |
| WO | 99/66151 | 12/1999 |
| WO | 99 66152 | 12/1999 |
| WO | 00 06854 | 2/2000 |
| WO | 00 66856 | 11/2000 |
| WO | WO 01/48333 | 7/2001 |
| WO | 01 66876 | 9/2001 |

OTHER PUBLICATIONS

Opposition II EPO. 698. 162—Facts—Arguments Evidence (11 pages)—translation.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc. et al.* vs. *International Trade Commission and Pergs, Inc. et al.* decided Sep. 10, 2003.

* cited by examiner

PROCESS FOR FINISHING A WOODEN BOARD AND WOODEN BOARD PRODUCED BY THE PROCESS

CROSS REFERENCE TO RELATED APPLICATIONS

This application is a continuation of U.S. application Ser. No. 10/792,270, now U.S. Pat. No. 7,678,425 filed on Mar. 4, 2004, the contents of which are incorporated herein by reference in their entirety, which claims priority under 35 U.S.C. §119 to German Application No. 103 10 199.3 filed on Mar. 6, 2003 and to European (EPO) Application No. 03020230.3 filed on Sep. 6, 2003.

BACKGROUND OF THE INVENTION

1. Field of the Invention

The invention generally relates to a wooden board and a process for finishing a wooden board, in particular an MDF or HDF board with an upper side and an underside. These boards may be used, for example, for furniture construction and panels, in particular flooring panels.

2. Background Description

Flooring panels with a substrate board made of wood are normally designated laminate panels and have been on the market for many years to substitute for parquet. The desired decoration (parquet, wood grain, tiles, and so on) is printed onto a paper web, which is subsequently coated with resin and rolled up on a roll or stacked as sheet goods. The decorative web prefabricated in this way is laid on the substrate board at the flooring manufacturer and is pressed.

As a result of printing the decoration onto the paper web, the later sealing of the paper web with synthetic resin and the subsequent connection of the decorative layer to the substrate board by means of pressure and temperature, the dimensions of the paper web are changed. Those skilled in the commonly refer to this phenomenon as paper growing. The paper grows both in length (lengthwise growth) and also in width (widthwise growth).

If this decorative board is then to be cut to size to form individual panels, the lengthwise and widthwise growth must be taken into account, since otherwise there would be an unequal distribution of the decoration on the individual panels. This would result in the floor assembled from an unequally distributed decorative layer having undulations in the decoration at the connecting edges of the panels. Even if such undulations in the decoration are only a few millimeters, they are striking when viewed, which has a detrimental influence on the esthetic impression and therefore reduces the quality of the laid floor.

In order to be able to produce in suitable quality, the paper growth must be registered and the saw which saws the panels out of the substrate board must be adjusted appropriately. Manual adjustment is very time-consuming. DE 100 19 054 C1 describes a method of cutting panels to size from a substrate board with which the saw can be matched automatically to the paper growth. For this purpose, cameras are needed which determine the actual position of defined decorative points. The actual position is then compared with the intended position and the deviation of the width or length dimension is determined, so that the saw can be adjusted appropriately.

In order to optimize the cutting, it is therefore necessary to expend a great deal of effort, which makes the production of high-quality panels expensive. In order further to match the visual quality of the laminate panel to the visual quality of a natural wood panel, in the press in which the decorative layer is pressed with the substrate board, a die plate having a relief can be provided, which impresses a relief corresponding to the wood grain into the synthetic resin layer. Since the paper growth is not reproducible, it is not possible to bring the relief completely into coincidence with the decoration. The joints of a tiled surface cannot be impressed into the surface, since deviations here would immediately be visible.

Starting from this problem, a process for finishing a wooden board is to be specified with which the disadvantages described above are avoided.

SUMMARY OF THE INVENTION

The problem is solved with a wooden board by means of the following steps:

a) applying a sealing layer of melamine resin to the upper side of the board,
b) printing a decoration onto the sealing layer,
c) applying a protective layer of melamine resin to the decoration, and
d) pressing the board under the action of temperature until the protective layer and the sealing layer melt and bond to each other with the inclusion of the decoration printed on.

The board is preferably further finished by means of the following steps:

e) applying a sealing layer of melamine resin to the underside of the board,
f) applying a colored layer to the sealing layer,
g) applying a protective layer of melamine resin to the colored layer,
h) pressing the board under the action of temperature until the protective layer and the sealing layer melt and bond to each other with the inclusion of the colored layer.

In another aspect of the invention, a wooden board, in particular flooring panel, comprises an HDF or MDF substrate board with an upper side and an underside. The upper side has a decoration, wherein a sealing layer onto which a decoration is printed is applied to the substrate board. The decoration is covered by at least one wear-resistant layer.

DETAILED DESCRIPTION OF EMBODIMENTS OF THE INVENTION

Figure 1:
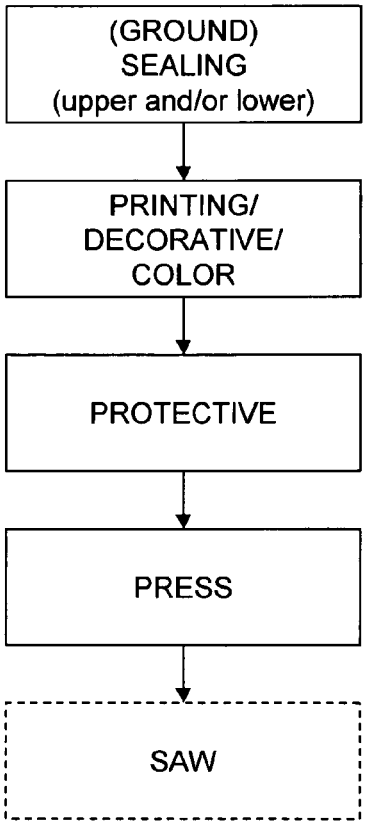
FIG. 1 shows a flow chart of the method of finishing a board in accordance with the invention.

Referring to FIG. 1, a flow chart of the method of finishing a board in accordance with the invention is shown. It should be understood that FIG. 1 is representative of the steps of the finishing process; however, FIG. 2 may equally represent some of the finishing processes as well as the resultant board or panel using the process of the invention. For example, the flow of FIG. 1 shows:

a) applying a sealing layer of melamine resin to the upper side of the board,
b) printing a decoration onto the sealing layer,
c) applying a protective layer of melamine resin to the decoration, and
d) pressing the board under the action of temperature until the protective layer and the sealing layer melt and bond to each other with the inclusion of the decoration printed thereon.

The fact that the decoration is printed onto the board means that not only are the problems associated with the paper growth avoided but also the handling associated with laying the paper web on the upper side of the board. As a result of applying the sealing layer to the substrate board, the printing ink is prevented from being absorbed by the substrate board, which would be the case without the sealing layer, since the substrate board as such is absorbent.

By means of the sealing layer, the decorative color is kept on the surface and bonded, so that the decorative layer remains on the surface and forms a precise, clearly visible decoration. The protective layer of melamine resin replaces the known overlay which, in the known finishing processes, is laid on the decorative paper. By means of the subsequent pressing under the action of temperature until the protective layer and the sealing layer melt, the decoration is enclosed and the sealing layer and protective layer become a composite. With the aid of the press plate, the level of gloss of the surface can be adjusted. If a polished press plate is used, a highly glossy surface is achieved.

The board is preferably further finished by means of the following steps, as represented in FIG. 1, for example.

(i) applying a sealing layer of melamine resin to the underside of the board, and (ii) applying a colored layer to the sealing layer.

The protective layer of melamine resin may be applied to the colored layer, and the board may be pressed under the action of temperature until the protective layer and the sealing layer melt and bond to each other with the inclusion of the colored layer.

By means of these steps, the otherwise usual undercoat in the case of a laminate panel is replaced. The individual layer thicknesses correspond to those on the upper side, so that distortion of the board is ruled out. It is particularly advantageous if the upper side and the underside are finished at the same time, which reduces the production time.

The finishing of the board can be carried out continuously, a continuous press preferably being used for the pressing. In this way, the production time is shortened further, which reduces the production costs.

The sealing layers 102 and/or the protective layers 104 are preferably applied in a plurality of individual layers, each individual layer drying out before the application of the next layer. The individual layers have a weight per unit area of 10-40 g/m.sup.2 in each case. The sealing layer 102 preferably includes two individual layers; the protective layer of four individual layers. In addition, the printing ink 106 can be applied in a plurality of layers.

In order that the decoration or the colored layer 106 does not melt or experience a color change during pressing, an appropriately heat-resistant color or heat-resistant varnish 107 can be applied in accordance with the invention. The varnish layer may be electron-beam cured or UV cured.

In order to obtain a smooth surface, the board 100 is preferably ground 108 before the first individual layer of the sealing layer is applied. Corundum 110 may be mixed into or scattered into at least one individual layer of the protective layer 104 in order to increase the abrasion resistance. Antibacterial and/or antistatic additives 112 can also be mixed into or scattered onto the protective layer 104. This can be carried out in the same or in another individual layer. All the individual layers are preferably treated correspondingly.

Fillers 116 can be introduced into the sealing layer 102 and/or the protective layer 104. Suitable fillers 116 are wood fibers, wood dust, metals, mineral substances (clay, sand), plastics, cellulose or ash. The fillers 116 can achieve a structure, which is applied so as to correspond with the decoration, so that fine reliefs can be produced. In the individual layers on the underside, the fillers are used, for example, for damping the sound of footfalls.

The finishing of the upper side of the board can also be carried out only in some regions. The finishing is preferably carried out on an area of the board running obliquely with respect to the upper side. For this purpose, a number of V joints 118 can be embossed into the upper side of the board. Following finishing, the board is sawed up centrally along the V joints, so that individual panels whose side edges have a chamfer are produced. These chamfers subsequently underline the visual impression of a joint between individual panels of a floor.

Since no paper layers are used, the boards are safe against distortion which could arise as a result of the inherent tensile force of the papers. Because of the thin layers, short process times can be implemented. The fillers introduced into the individual layers on the underside of the board can be provided in order to dampen the sound of foot steps, for example.

Instead of finishing a substrate board of high or medium density fibreboard (HDF or MDF), oriented strand board (OSB boards) or conventional chipboards with a correspondingly finely distributed top layer can also be used. It is also conceivable to form the sealing layer so thickly that irregularities in the board (OSB) are compensated for. The boards can be used not only as flooring panels but can also be used in furniture construction.

Parts of the process according to the invention are suitable to impart laminate properties to a board with a real wood surface (wooden substrate board with veneer layer, solid wood), specifically high abrasion resistance, high impact resistance and an adjustable level of gloss. For this purpose, it is possible to dispense with the application of the decorative layer to the upper side or the colored layer to the underside. The subsequent sealing of the laid parquet can therefore be dispensed with. By printing on an appropriate decorative layer, inexpensive timbers can be increased in value. For example, an oak decoration can be printed onto a pine veneer and its color emphasized appropriately.

The press plate can be provided with a relief corresponding to the decoration, when the board is pressed, depressions are then produced in the protective layer, which for example correspond to a wood grain or to a tiled surface. The touch of the surface is then matched to a natural surface.

Figure 2:
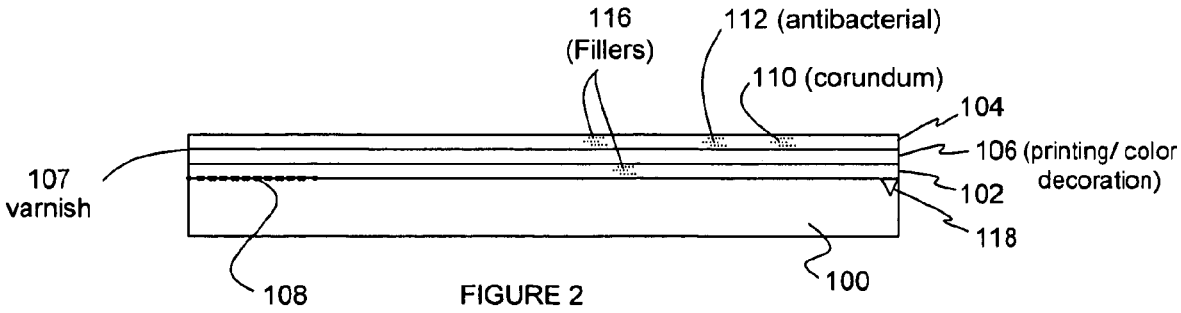
FIG. 2 shows a cross sectional view of an embodiment of the board in accordance with the invention.

In particular, V joints running in the longitudinal direction and/or transverse direction of the board can be impressed into the protective layer. During the further processing, panels are then sawed from the board by sawing being carried out centrally along the V joints. As a result, the panels are then given a chamfered edge. These features are shown in FIG. 2, which can equally represent the process of finishing the boards.

While the invention has been described in terms of embodiments, those skilled in the art will recognize that the invention can be practiced with modification within the spirit and scope of the appended claims.

What is claimed:

1. A process for finishing a wood or wooden board, the board having an upper side and an underside, the process comprising:

applying a sealing layer of melamine or urea resin to the upper side of the board, printing a decoration onto the sealing layer, applying a protective layer of melamine resin to the decoration, pressing the board under action of temperature until the protective layer and the sealing layer melt and bond to each other with inclusion of the decoration printed thereon, and creating depressions in the protective layer when the board is pressed by using a press plate being provided with a relief corresponding to the decoration.

2. The process according to claim 1, further comprising providing at least one filler into at least one of a sealing layer and the protective layer.

3. The process according to claim 2, wherein the filler is wood fibers, wood dust, metals, mineral substances, plastics, cellulose, or ash.

4. The process according to claim 1, wherein the board comprises an MDF board or an HDF board.

5. The process according to claim 1, further comprising:

applying a sealing layer of melamine resin to the underside of the board, applying a colored layer to the sealing layer on the underside of the board, applying a protective layer of melamine resin to the colored layer, and pressing the board under the action of temperature until the protective layer and the sealing layer melt and bond to each other with the inclusion of the colored layer.

6. The process according to claim 5, wherein the upper side and the underside are finished at a same time.

7. The process according to claim 1, wherein a plurality of individual layers are applied for at least one of the sealing layer and the protective layer and each individual layer dries out before the application of a next of the layers.

8. The process according to claim 5, wherein the board is ground before the sealing layer on the upper side is applied.

9. The process according to claim 7, further comprising providing corundum into at least one of the individual layers of the protective layer.

10. The process according to claim 7, further comprising scattering corundum onto at least one of the individual layers of the protective layer.

11. The process according to claim 7, further comprising mixing at least one of antibacterial and antistatic additives into at least one of the individual layers of the protective layer.

12. The process according to claim 7, further comprising scattering at least one of antibacterial and antistatic additives onto at least one of the individual layers of the protective layer.

13. The process according to claim 1, wherein finishing of the upper side of the board is carried out only in some regions.

14. The process according to claim 2, wherein finishing is carried out on an area running obliquely with respect to the upper side.

15. A process for creating an undercoat for a decorative wood or wooden board, the board having an upper side and an underside, the process comprising:

applying a sealing layer of melamine resin to the underside of the board, applying a colored layer to the sealing layer on the underside of the board, applying a protective layer of melamine resin to the colored layer, and pressing the board under the action of temperature until the protective layer and the sealing layer melt and bond to each other with the inclusion of the colored layer.

16. The process according to claim 15, wherein the board comprises an MDF board or an HDF board.

* * * * *